US011042115B1

(12) United States Patent
Otsuka

(10) Patent No.: US 11,042,115 B1
(45) Date of Patent: Jun. 22, 2021

(54) IMAGE FORMING APPARATUS

(71) Applicant: TOSHIBA TEC KABUSHIKI KAISHA, Tokyo (JP)

(72) Inventor: Takuya Otsuka, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/121,886

(22) Filed: Dec. 15, 2020

(30) Foreign Application Priority Data

Mar. 23, 2020 (JP) ..... JP2020-051924

(51) Int. Cl.

| | |
|---|---|
| ***G03G 21/16*** | (2006.01) |
| ***G03G 15/16*** | (2006.01) |
| ***G03G 15/04*** | (2006.01) |
| ***G03G 15/01*** | (2006.01) |

(52) U.S. Cl.
CPC ..... *G03G 21/1619* (2013.01); *G03G 15/0136* (2013.01); *G03G 15/04054* (2013.01); *G03G 15/162* (2013.01); *G03G 21/1647* (2013.01); *G03G 2221/1636* (2013.01); *G03G 2221/1654* (2013.01); *G03G 2221/1678* (2013.01)

(58) Field of Classification Search
CPC ..... G03G 15/011; G03G 15/04054; G03G 21/1619; G03G 21/1647; G03G 2221/1636; G03G 2221/1654; G03G 2221/1678
See application file for complete search history.

(56) References Cited

U.S. PATENT DOCUMENTS

| | | | | |
|---|---|---|---|---|
| 6,236,820 | B1 | 5/2001 | Nakazato et al. | |
| 2005/0062836 | A1* | 3/2005 | Nakajima | G03G 15/011 347/225 |
| 2013/0004199 | A1* | 1/2013 | Souda | G03G 21/1853 399/110 |
| 2019/0129327 | A1 | 5/2019 | Aruga et al. | |

FOREIGN PATENT DOCUMENTS

| | | |
|---|---|---|
| JP | 2002-169353 | 6/2002 |
| JP | 2004-086088 | 3/2004 |

* cited by examiner

*Primary Examiner* — Benjamin R Schmitt
(74) *Attorney, Agent, or Firm* — Amin, Turocy & Watson, LLP

(57) ABSTRACT

According to one embodiment, in an image forming apparatus, a frame that supports a transfer belt conveying a toner image in a conveyance direction and image forming units aligned along the transfer belt is provided with a dowel hole between the image forming units in a direction parallel to the conveyance direction and is also provided with an elongated hole having a long axis in a direction parallel to the conveyance direction, a dowel between the exposure units of a chassis supporting exposure units in a direction parallel to the conveyance direction is fitted to the dowel hole, and another dowel is inserted into the elongated hole.

20 Claims, 3 Drawing Sheets

IMAGE FORMING APPARATUS

CROSS-REFERENCE TO RELATED APPLICATION

This application is based upon and claims the benefit of priority from Japanese Patent Application No. 2020-051924, filed on Mar. 23, 2020, the entire contents of which are incorporated herein by reference.

FIELD

Embodiments described herein relate generally to an image forming apparatus and an image processing mechanism for use in an image forming apparatus.

BACKGROUND

As one of the configurations of an electro-photographic image forming apparatus, there is known a so-called tandem method in which toner images of four colors are drawn on one transfer belt.

The number of configurations in which an exposure unit including a rod-shaped so-called LED array in which light emitting diodes are aligned in the longitudinal direction is used for an exposure device for drawing an electrostatic latent image on a photoreceptor drum of each of four color image forming units has also increased.

There is also a configuration in which four exposure units facing each other for exposing each of four color image forming units are mounted on one chassis and the chassis is fixed to a frame of the image forming apparatus.

DETAILED DESCRIPTION

An aspect of the present disclosure is to perform positioning four exposure units mounted on one chassis and image forming units of respective four colors with excellent accuracy.

In general, according to one embodiment, an image forming apparatus includes an image carrier that conveys a toner image from upstream to downstream in a conveyance direction; a first image forming unit that forms a toner image on the image carrier; a second image forming unit that forms a toner image on the image carrier downstream of the first image forming unit; a third image forming unit that forms a toner image on the image carrier downstream of the second image forming unit; a fourth image forming unit that forms a toner image on the image carrier downstream of the third image forming unit; a chassis that supports a first exposure unit for exposing the first image forming unit, a second exposure unit for exposing the second image forming unit, a third exposure unit for exposing the third image forming unit, and a fourth exposure unit for exposing the fourth image forming unit, and that includes a first fitting portion, and a second fitting portion between the second exposure unit and the third exposure unit in a direction parallel to the conveyance direction; and a frame that includes a third fitting portion to be fitted with the first fitting portion and a fourth fitting portion to be fitted with the second fitting portion, and supports the chassis whose relative position is positioned at the fourth fitting portion, the first image forming unit, the second image forming unit, the third image forming unit, the fourth image forming unit, and the image carrier, wherein one of the first fitting portion and the third fitting portion is an elongated hole having a long axis in a direction parallel to the conveyance direction, and the other is inserted into the elongated hole.

Figure 1:
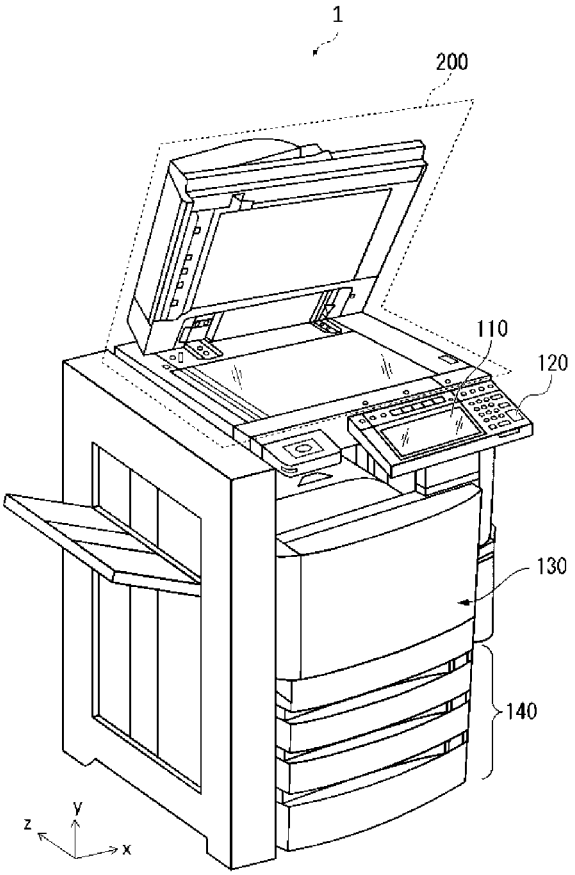
FIG. 1 is a perspective view of an outer appearance of an image forming apparatus according to an embodiment as viewed from the upper left of the front.

Hereinafter, an image forming apparatus and a control method of the image forming apparatus according to an embodiment will be described with reference to the drawings. FIG. 1 is a perspective view of an outer appearance of an image forming apparatus 1 according to the embodiment as viewed from the upper left of the front. At the lower left of FIG. 1, an arrow x directing from the left side to the right side of the image forming apparatus 1, an arrow y directing from the floor side to the top, and an arrow z directing from the front side to the rear side are illustrated.

The image forming apparatus 1 includes a display 110, a control panel 120, an image forming unit 130, a sheet accommodating unit 140, and an image reading unit 200.

A toner cartridge is mounted on the image forming apparatus 1. The toner cartridge may be filled with a decolorable toner that can be decolorized later or may be filled with a toner that cannot be decolorized later.

The image forming apparatus 1 forms an image on a sheet by using a toner.

The display 110 is an image display device such as a liquid crystal display or an organic EL (Electro Luminescence) display. The display 110 displays various pieces of information on the image forming apparatus 1.

The control panel 120 includes a plurality of buttons for receiving user operations. The display 110 and the control panel 120 may be configured as an integrated touch panel.

The image forming unit 130 forms an image on a sheet based on image information generated by the image reading unit 200 and image information received via a communication line.

The image reading unit 200 reads the image information to be read based on brightness and darkness of light. The image reading unit 200 records the read image information. The recorded image information may be transmitted to another information processing apparatus via a network. The recorded image information may be formed as an image on the sheet by the image forming unit 130.

Figure 2:
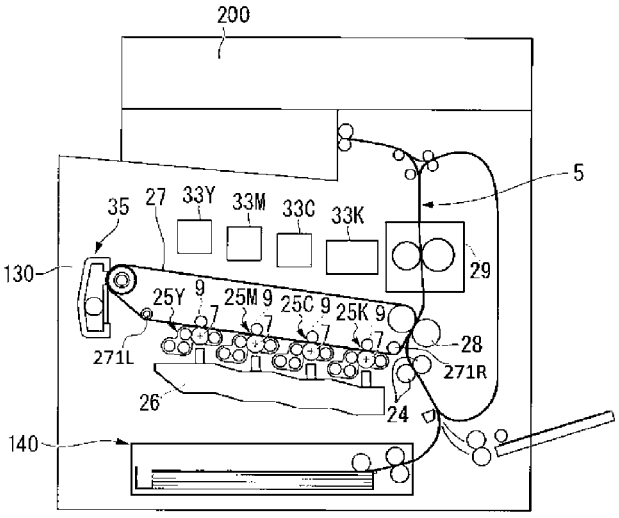
FIG. 2 is a configuration diagram of the image forming apparatus as viewed from the front side of the image forming unit.

FIG. 2 is a configuration diagram of the image forming apparatus 1 viewed from the front side. The image forming apparatus 1 includes the image reading unit 200, the image forming unit 130, the sheet accommodating unit 140, and a conveyance unit 5.

The conveyance unit 5 includes a registration roller 24 and a transfer roller 28. The registration roller 24 adjusts the posture of the leading end of the sheet and conveys the sheet when the image forming unit 130 transfers the toner image to the sheet. The registration roller 24 conveys the sheet to the transfer roller 28.

The image forming unit 130 includes an image forming unit 25Y as a first image forming unit, an image forming unit 25M as a second image forming unit, an image forming unit 25C as a third image forming unit, an image forming unit 25K as a fourth image forming unit, an exposure unit 26, a transfer belt 27 as an image carrier, a fixing unit 29, toner cartridges 33Y, 33M, 33C, and 33K, and a transfer belt cleaner 35.

The transfer belt 27 has an image forming surface, which is a surface facing the image forming units 25Y, 25M, 25C, and 25K. The image forming surface is inclined with respect to the floor at an inclination angle D so as to be lowered from the left side to the right side as viewed from the front side in order to secure a sufficient length. The transfer belt 27 includes rollers 271L and 271R on the back surface of the image forming surface, which define the inclination angle D of the image forming surface. The transfer belt 27 is provided with a transfer roller 9 for attracting the toner image from each of the image forming units 25Y, 25M, 25C, and 25K, on the back surface of the surface facing each of the image forming units 25Y, 25M, 25C, and 25K between the roller 271L and the roller 271R. The transfer belt 27 conveys the toner images received in order from the image forming units 25Y, 25M, 25C, and 25K to the transfer roller 28. The transfer roller 28 transfers the toner images to the sheet.

The image forming units 25Y, 25M, 25C, and 25K are aligned in order in the traveling direction of the facing surfaces of the transfer belt 27. The image forming units 25Y, 25M, 25C, and 25K are installed in order near the floor along the inclination angle D so as to be along the transfer belt 27 which is inclined with respect to the floor from the left side to the right side as viewed from the front side. The image forming unit 25Y forms a yellow toner image. The image forming unit 25M forms a magenta toner image. The image forming unit 25C forms a cyan toner image. The image forming unit 25K forms a black toner image. Each of the image forming units 25Y, 25M, 25C, and 25K includes a photoreceptor drum 7 and performs charging, developing, cleaning, removing electricity, and the like on the photoreceptor drum 7.

The fixing unit 29 fixes the toner images on the sheet on which the toner images are transferred by the transfer roller 28.

The toner cartridges 33Y, 33M, 33C, and 33K are provided above the transfer belt 27. The toner cartridge 33Y contains a yellow toner for being supplied to the image forming unit 25Y via a supply pipe. The toner cartridge 33M contains a magenta toner for being supplied to the image forming unit 25M via a supply pipe. The toner cartridge 33C contains a cyan toner for being supplied to the image forming unit 25C via a supply pipe. The toner cartridge 33K contains a black toner for being supplied to the image forming unit 25K via a supply pipe.

After the toner image is transferred to the sheet by the transfer roller 28, the transfer belt cleaner 35 removes the toner remaining on the transfer belt 27.

The exposure unit 26 exposes the four photoreceptor drums 7 to form an electrostatic latent image.

Figure 3:
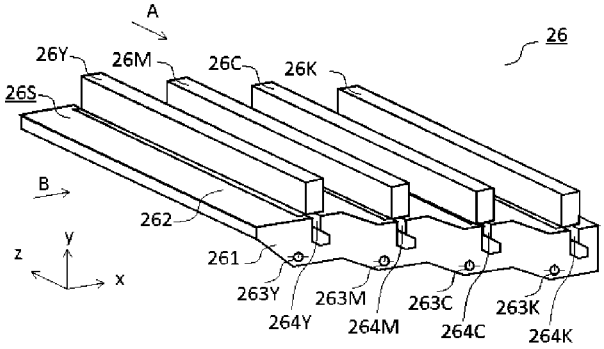
FIG. 3 is a perspective view of an exposure unit.

FIG. 3 is a perspective view of the exposure unit 26. The exposure unit 26 includes an exposure unit 26Y as a first exposure unit, an exposure unit 26M as a second exposure unit, an exposure unit 26C as a third exposure unit, an exposure unit 26K as a fourth exposure unit, and a chassis 26S. At the lower left of FIG. 3, an arrow x directing from the left side to the right side of the image forming apparatus 1, an arrow y directing from the floor side to the top, and an arrow z directing from the front side to the rear side are illustrated.

The chassis 26S holds the exposure units 26Y, 26M, 26C, and 26K so as to be sequentially lowered in accordance with the image forming units 25Y, 25M, 25C, and 25K which are provided in lower positions in order from the left side to the right side as viewed from the front side.

Each of the exposure units 26Y, 26M, 26C, and 26K takes a high posture or a low posture with respect to the chassis 26S. The exposure units 26Y, 26M, 26C, and 26K can independently change the postures with respect to the chassis 26S within the same stroke length range.

A bracket 261 of the chassis 26S is a plate-shaped portion extending downward on the front side from a bucket 262 that holds the exposure units 26Y, 26M, 26C, and 26K.

At the bottom of the bracket 261, there are fastening holes 263Y, 263M, 263C, and 263K that penetrate the front side and the rear side. The straight line connecting the fastening holes 263Y, 263M, 263C, and 263K to each other is inclined with respect to the floor at an inclination angle D.

At the top of the bracket 261, slots 264Y, 264M, 264C, and 264K into which the exposure units 26Y, 26M, 26C, and 26K are inserted from the above are provided in a form of penetrating the bucket 262.

Figure 4:
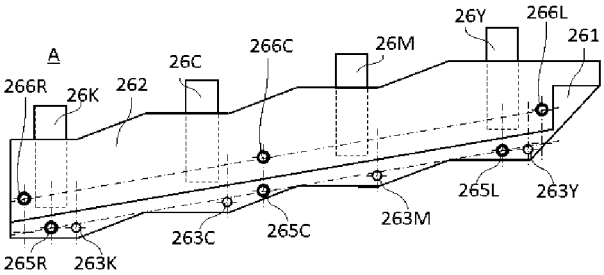
FIG. 4 is a view of the exposure unit as viewed from the rear side.
Figure 5:
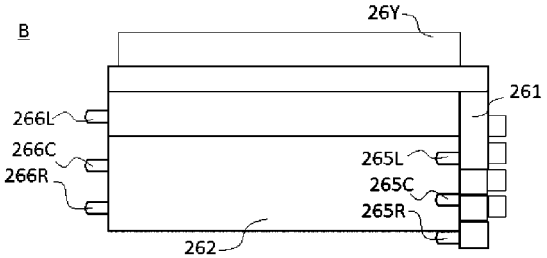
FIG. 5 is a view of the exposure unit as viewed from the left side.

FIG. 4 is a view of the exposure unit 26 as viewed from the viewpoint of the arrow A illustrated above FIG. 3, that is, as viewed from the rear side. FIG. 5 is a view of the exposure unit 26 as viewed from the viewpoint of the arrow B illustrated on the left side of FIG. 3, that is, as viewed from the left side.

A front dowel 265L as a first fitting portion, a front dowel 265C as a second fitting portion, and a front dowel 265R project from the lower rear surface of the bracket 261.

The straight line connecting the front dowels 265L, 265C, and 265R to each other is inclined with respect to the floor at an inclination angle D.

A rear dowel 266L as a first fitting portion, a rear dowel 266C as a second fitting portion, and a rear dowel 266R project from the rear surface of the bucket 262.

The straight line connecting the rear dowels 266L, 266C, and 266R is inclined with respect to the floor at an inclination angle D.

The front dowel 265L is located farther from the floor than the rear dowel 266L. The front dowel 265C is located farther from the floor than the rear dowel 266C. The front dowel 265R is located farther from the floor than the rear dowel 266R.

The front dowel 265C is located between the slot 264M and the slot 264C among the four slots 264Y, 264M, 264C, and 264K aligned in order from the left in the left-right direction. That is, the front dowel 265C is located between the exposure unit 26M and the exposure unit 26C among the four exposure units 26Y, 26M, 26C, and 26K aligned in order from the left in the left-right direction.

The rear dowel 266C is located between the slot 264M and the slot 264C among the four slots 264Y, 264M, 264C, and 264K aligned in order from the left in the left-right direction. That is, the rear dowel 266C is located between the exposure unit 26M and the exposure unit 26C among the four exposure units 26Y, 26M, 26C, and 26K aligned in order from the left in the left-right direction.

The rear dowel 266L of the left side is on the left side of the front dowel 265L of the left side. The rear dowel 266R of the right side is on the right side of the front dowel 265R of the right side. That is, the distance between the left rear dowel 266L and the right rear dowel 266R in the left-right direction is larger than the distance between the left front dowel 265L and the right front dowel 265R. Since the left rear dowel 266L and the right rear dowel 266R are aligned in an inclined direction, the distance therebetween in the vertical direction is larger than the distance between the left front dowel 265L and the right front dowel 265R.

Figure 6:
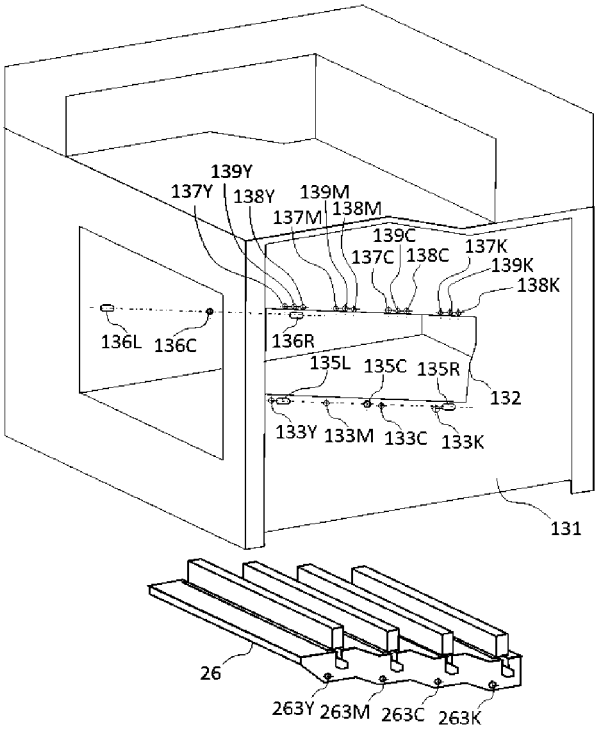
FIG. 6 is a perspective view of a frame and an exposure unit around an image forming unit as viewed from the upper left of the front.

FIG. 6 is a perspective view of a frame 131 and the exposure unit 26 around the image forming unit 130 of the image forming apparatus 1 as viewed from the upper left of the front. The frame 131 supports the image forming units 25Y, 25M, 25C, and 25K, the exposure unit 26, and the transfer belt 27. The frame 131 serves as a reference for positioning the image forming units 25Y, 25M, 25C, and 25K, the exposure unit 26, and the transfer belt 27. The frame 131 includes a slot 132 on the front side. The image forming units 25Y, 25M, 25C, and 25K and the exposure unit 26 are inserted into the slot 132 from the front side.

Below the lower side of the slot 132, there are a front dowel hole 135L as a third fitting portion, a front dowel hole 135C as a fourth fitting portion, and a front dowel hole 135R as a third fitting portion. The front dowel holes 135L, 135C, and 135R are aligned on a straight line parallel to the image forming surface of the transfer belt 27. The front dowel holes 135L and 135R are elongated holes having a long axis parallel to the image forming surface of the transfer belt 27. The front dowel hole 135C between the front dowel hole 135L and the front dowel hole 135R is a round hole.

When the exposure unit 26 is inserted into the slot 132, the front dowel 265C is fitted to the front dowel hole 135C. When the exposure unit 26 is inserted into the slot 132, the front dowel 265L is inserted into the front dowel hole 135L with play in the long axis direction of the front dowel hole 135L. When the exposure unit 26 is inserted into the slot 132, the front dowel 265R is inserted into the front dowel hole 135R with play in the long axis direction of the front dowel hole 135R. That is, the front dowel hole 135C serves as a positioning hole for the exposure unit 26.

On the rear wall of the frame 131 at the back of the slot 132, there are a rear dowel hole 136L as a third fitting portion, a rear dowel hole 136C as a fourth fitting portion, and a rear dowel hole 136R as a third fitting portion. The rear dowel holes 136L, 136C, and 136R are aligned on a straight line parallel to the image forming surface of the transfer belt 27. The rear dowel holes 136L and 136R are elongated holes having a long axis parallel to the image forming surface of the transfer belt 27. The rear dowel hole 136C between the rear dowel hole 136L and the rear dowel hole 136R is a round hole.

When the exposure unit 26 is inserted into the slot 132, the rear dowel 265C is fitted to the rear dowel hole 136C. When the exposure unit 26 is inserted into the slot 132, the rear dowel 265L is inserted into the rear dowel hole 136L with play in the long axis direction of the rear dowel hole 136L. When the exposure unit 26 is inserted into the slot 132, the rear dowel 265R is inserted into the rear dowel hole 136R with play in the long axis direction of the rear dowel hole 136R. That is, the rear dowel hole 136C serves as a positioning hole for the exposure unit 26.

The front dowel holes 135C and the rear dowel holes 136C serve as positioning holes for the exposure unit 26 with respect to the frame 131, and the front dowel holes 135L and 135R and the rear dowel holes 136L and 136R which are elongated holes serve to absorb the dimensional error of the exposure unit 26.

Since the front dowel 265C fitted to the front dowel hole 135C is located between the exposure unit 26M and the exposure unit 26C in the left-right direction, the position errors of the exposure unit 26Y and the exposure unit 26K with respect to the positioning hole can be reduced. In addition, since the rear dowel 265C fitted to the rear dowel hole 136C is located between the exposure unit 26M and the exposure unit 26C in the left-right direction, the position errors of the exposure unit 26Y and the exposure unit 26K with respect to the positioning hole can be reduced.

Below the lower side of slot 132, there are also fastening holes 133Y, 133M, 133C, and 133K. The fastening hole 263Y of the exposure unit 26 inserted into the slot 132 and the fastening hole 133Y of the frame 131 are fastened with one screw. The fastening hole 263M of the exposure unit 26 inserted into the slot 132 and the fastening hole 133M of the frame 131 are fastened with one screw. The fastening hole 263C of the exposure unit 26 inserted into the slot 132 and the fastening hole 133C of the frame 131 are fastened with one screw. The fastening hole 263K of the exposure unit 26 inserted into the slot 132 and the fastening hole 133K of the frame 131 are fastened with one screw. The fastening holes 133Y, 133M, 133C, and 133K are aligned on a straight line parallel to the image forming surface of the transfer belt 27.

Above the upper side of the slot 132, there are holes 137Y, 138Y, 139Y, 137M, 138M, 139M, 137C, 138C, 139C, 137K, 138K, and 139K aligned on a straight line parallel to the image forming surface of the transfer belt 27.

The holes 137Y, 138Y, and 139Y are used to mount the image forming unit 25Y on the frame 131. The holes 137M, 138M, and 139M are used to mount the image forming unit 25M on the frame 131. The holes 137C, 138C, and 139C are used to mount the image forming unit 25C on the frame 131. The holes 137K, 138K, and 139K are used to mount the image forming unit 25K on the frame 131.

The holes 137Y, 137M, 137C, and 137K are round holes that serve as positioning holes. The holes 138Y, 138M, 138C, and 138K are elongated holes having a long axis parallel to the image forming surface of the transfer belt 27. The holes 139Y, 139M, 139C, and 139K are holes through which screws for fastening them to the frame 131 are passed.

Figure 7:
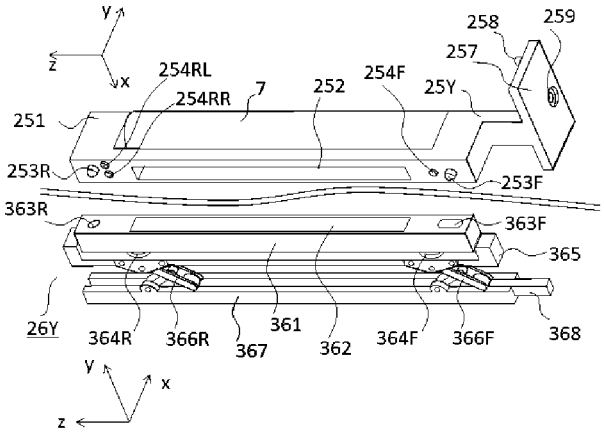
FIG. 7 is a perspective view of an exposure unit and a part of the image forming unit in a posture tilted 90 degrees as viewed from the front side.

FIG. 7 is a perspective view of the exposure unit 26Y. The photoreceptor drum 7 and a part of the image forming unit 25Y are also drawn in a posture tilted 90 degrees as viewed from the front side. In addition, the exposure units 26M, 26C, and 26K have the same configuration as the exposure unit 26Y. The image forming units 25M, 25C, and 25K have the same configuration as the image forming unit 25Y. The exposure unit 26Y includes a head 361, a front hole 363F, and a rear hole 363R as a sixth fitting portion, springs 364F and 364R, a stage 365, linkages 366F and 366R, a rail 367, and a handle 368.

The head 361 is an exposure device having an LED array of which longitudinal direction is along the front-rear direction. The head 361 emits light emitted from the LED array from an exposure window 362 of the upper surface.

The upper surface of the head 361 includes the front hole 363F on the front side of the exposure window 362. The front hole 363F is an elongated hole having a long axis along the front-rear direction. The upper surface of the head 361 is a flat front seat surface between the exposure window 362 and the front hole 363F. The upper surface of the head 361 includes the rear hole 363R on the rear side of the exposure window 362. The rear hole 363R is a round hole that serves as a positioning hole. The upper surface of the head 361 is a flat rear seat surface between the exposure window 362 and the rear hole 363R.

The lower surface of the head 361 is supported by the springs 364F and 364R. The upper portion of the spring 364F comes into contact with the lower facing surface of the front seat surface of the head 361. The upper portion of the spring 364R comes into contact with the lower facing surface of the rear seat surface of the head 361. The lower portions of the springs 364F and 364R are supported by the upper portion of the stage 365. The stage 365 restricts the relative displacement of the springs 364F and 364R in the front-rear direction.

The lower portion of the stage 365 is supported by linkages 366F and 366R. The upper portion of the linkage 366F is connected to the lower facing surface of the support portion of the spring 364F of the stage 365. The upper portion of the linkage 366R is connected to the lower facing surface of the support portion of the spring 364R of the stage 365. The stage 365 restricts the relative displacement of the linkages 366F and 366R in the front-rear direction.

The lower portions of the linkages 366F and 366R are rotationally supported by the rail 367 and the handle 368, respectively. By moving the handle 368 with respect to the rail 367 along the front-rear direction, the linkages 366F and 366R convert the shape change of the lower portion in the front-rear direction into the displacement of the upper portion in the vertical direction. By displacing the upper portions of the linkages 366F and 366R in the vertical direction, the head 361 is displaced in the vertical direction via the stage 365 and the springs 364F and 364R. The rail 367 is fixed to the slot 264Y of the chassis 26S of the exposure unit 26. The rail 367 is fixed to the bucket 262, and the head 361 moves up and down with respect to the bucket 262 as the handle 368 moves in the front-rear direction.

The image forming unit 25Y supporting the photoreceptor drum 7 includes a chassis 251, a front dowel 253F, and a rear dowel 253R as a fifth fitting portion, a front port 254F, rear ports 254RL and 254RR, a bracket 257, a dowel 258, and a fastening hole 259.

The chassis 251 rotatably supports the photoreceptor drum 7 around an axis parallel to the front-rear direction. The chassis 251 includes the bracket 257 on the front side. The bracket 257 includes the dowel 258 on the rear surface side.

The bracket 257 includes the fastening hole 259 that penetrates the front side and the rear surface side. The dowel 258 and the fastening hole 259 are aligned on a straight line parallel to the image forming surface of the transfer belt 27. The rear surface of the bracket 257 includes another dowel on the straight line where the dowel 258 and the fastening hole 259 are aligned so as to interpose the fastening hole 259 between the rear surface of the bracket 257 and the dowel 258.

When the image forming unit 25Y is inserted into the slot 132, the dowel 258 is fitted to the hole 137Y of the frame 131. When the image forming unit 25Y is inserted into the slot 132, another dowel is inserted into the hole 138Y of the frame 131 with play in the long axis direction of the hole 138Y. That is, the hole 137Y serves as a positioning hole for the image forming unit 25Y. The fastening hole 259 of the image forming unit 25Y inserted in the slot 132, and the hole 139Y of the frame 131 are fastened with one screw. In addition, needless to say, the rear side of the chassis 251 also has a structure for positioning and fixing to the frame 131.

The chassis 251 includes a window 252 at a position facing the lower surface of the photoreceptor drum 7. The light emitted from the exposure window 362 on the upper surface of the head 361 of the exposure unit 26Y reaches the photoreceptor drum 7 through the window 252.

The lower surface of the chassis 251 includes the front dowel 253F on the front side of the window 252. The lower surface of the chassis 251 includes the front port 254F between the front dowel 253F and the window 252. The lower surface of the front port 254F is flat.

The lower surface of the chassis 251 includes the rear dowel 253R on the rear side of the window 252. The lower surface of the chassis 251 includes the rear ports 254RL and 254RR between the rear dowel 253R and the window 252. The lower surfaces of the rear ports 254RL and 254RR are flat. The rear ports 254RL and 254RR are aligned with each other in the left-right direction.

When the head 361 rises with respect to the bucket 262, the front seat surface of the head 361 presses against the lower surface of the front port 254F of the chassis 251. The front seat surface and the lower surface of the front port 254F, which press against each other, serve as positioning surfaces that determine the relative position of the chassis 251 of the head 361 in the vertical direction. When the head 361 rises with respect to the bucket 262, the rear seat surface of the head 361 presses against the lower surfaces of the rear ports 254RL and 254RR of the chassis 251. The rear seat surface and the lower surfaces of the rear ports 254RL and 254RR, which press against each other, serve as positioning surfaces that determine the relative position of the chassis 251 of the head 361 in the vertical direction. Since the head 361 presses against three portions, that is, the front port 254F on the front side, the rear port 254RL of the left on the rear side, and the rear port 254RR of the right on the rear side, the relative posture between the head 361 and the chassis 251 is stable.

When the head 361 rises with respect to the bucket 262, the rear dowel 253R of the chassis 251 is fitted to the rear hole 363R of the head 361. When the head 361 rises with respect to the bucket 262, the front dowel 253F of the chassis 251 is inserted into the front hole 363F of the head 361 with play in the long axis direction of the front hole 363F. That is, the rear hole 363R serves as a positioning hole that determines the relative positions of the head 361 and the chassis 251 in the front-rear direction and the left-right direction, and the front hole 363F that is an elongated hole serves as a positioning hole that determines the relative positions of the head 361 and the chassis 251 in the left-right direction.

Since the relative positions of the frame 131 and the exposure unit 26 in the left-right direction are positioned between the exposure unit 26M and the exposure unit 26C, the position errors of the exposure unit 26Y and the exposure unit 26K in the left-right direction can be small, and thus, even in a structure which is performed by inserting the front dowel 253F into the front hole 363F and fitting the rear dowel 253R into the rear hole 363R, the relative positions of the head 361 and the chassis 251 in the left-right direction can be determined with a small stress without great distortion of the linkages 366F and 366R and other structures.

In addition, the front dowels 265L, 265C, and 265R may not be aligned on a straight line, and any one of the front dowel 265L and the front dowel 265R may not be present. The rear dowels 266L, 266C, and 266R may not be aligned on a straight line, and any one of the rear dowel 266L and the rear dowel 266R may not be present. The front dowel holes 135L, 135C, and 135R may not be aligned on a straight line, and any one of the front dowel hole 135L and the front dowel hole 135R may not be present. The rear dowel holes 136L, 136C, and 136R may not be aligned on a straight line, and any one of the rear dowel hole 136L and the rear dowel hole 136R may not be present. The front dowel hole 135C and the rear dowel hole 136C may be elongated holes having a long axis perpendicular to the image forming surface of the transfer belt 27. The fastening holes 133Y, 133M, 133C, and 133K may not be aligned on a straight line, and the number of the fastening holes may not be four. The fastening holes 263Y, 263M, 263C, and 263K may not be aligned on a straight line, and the number of fastening holes may not be four. The holes 137Y, 138Y, 139Y, 137M, 138M, 139M, 137C, 138C, 139C, 137K, 138K, and 139K may not be aligned on a straight line. The dowel 258, the fastening hole 259, and one more dowel on the rear surface of the bracket 257 may not be aligned on a straight line. As an example of the structure of positioning the chassis 251 of the image forming unit 25Y and the head 361 of the exposure unit 26Y, the structure where the front dowel 253F and the rear dowel 253R which are convex structures are present in the chassis 251 of the image forming unit 25Y, and the front hole 363F and the rear hole 363R having concave structures are present in the head 361 of the exposure unit 26Y is described, but as long as the convex structure and the concave structure are paired, the convex structure and the concave structure may be present at any one of the chassis 251 and the head 361. As an example of the structure of the portion where the chassis 251 of the image forming unit 25Y and the head 361 of the exposure unit 26Y press against each other, the structures having the front port 254F, the rear ports 254RL and 254RR, the front seat surface, and the rear seat surface is described, but as long as the port and the seat surface are paired, the port and the seat surface may be present at any one of the chassis 251 and the head 361.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus, comprising:

an image carrier configured to convey a toner image from upstream to downstream in a conveyance direction;

a first image forming unit configured to form a toner image on the image carrier;

a second image forming unit configured to form a toner image on the image carrier downstream of the first image forming unit;

a third image forming unit configured to form a toner image on the image carrier downstream of the second image forming unit;

a fourth image forming unit configured to form a toner image on the image carrier downstream of the third image forming unit;

a chassis configured to support a first exposure unit for exposing the first image forming unit, a second exposure unit for exposing the second image forming unit, a third exposure unit for exposing the third image forming unit, and a fourth exposure unit for exposing the fourth image forming unit, and the chassis comprising a first fitting portion, and a second fitting portion between the second exposure unit and the third exposure unit in a direction parallel to the conveyance direction; and a frame comprising a third fitting portion configured to fit with the first fitting portion, and a fourth fitting portion configured to fit with the second fitting portion, the frame configured to support the chassis whose relative position is positioned at the fourth fitting portion, the first image forming unit, the second image forming unit, the third image forming unit, the fourth image forming unit, and the image carrier, wherein one of the first fitting portion and the third fitting portion is an elongated hole having a long axis in a direction parallel to the conveyance direction, and the other of the first fitting portion and the third fitting portion is positioned within the elongated hole.

2. The image forming apparatus according to claim 1, wherein the chassis has the first fitting portion and the second fitting portion on a front side and a rear side.

3. The image forming apparatus according to claim 1, wherein the frame has the third fitting portion and the fourth fitting portion on a front side and a rear side.

4. The image forming apparatus according to claim 1, wherein the frame has the first fitting portions on left and right sides of the second fitting portion.

5. The image forming apparatus according to claim 4, wherein the first image forming unit comprises a fifth fitting portion, and the first exposure unit comprises a sixth fitting portion configured to fit with the fifth fitting portion.

6. The image forming apparatus according to claim 1, wherein the image carrier is positioned at an inclination angle whereby an upstream portion is higher than a downstream portion in the conveyance direction.

7. The image forming apparatus according to claim 1, wherein the image carrier comprises a transfer belt, and the image forming apparatus further comprises a transfer belt cleaner.

8. The image forming apparatus according to claim 1, wherein the first image forming unit, the second image forming unit, the third image forming unit, and the fourth image forming unit independently comprises one of yellow toner, magenta toner, cyan toner, and black toner.

9. The image forming apparatus according to claim 1, wherein the first exposure unit, the second exposure unit, the third exposure unit, and the fourth exposure unit each comprise an LED array.

10. The image forming apparatus according to claim 1, wherein at least one of the first image forming unit, the second image forming unit, the third image forming unit, and the fourth image forming unit comprises a decolorable toner.

11. An image processing mechanism, comprising:

a first image forming unit configured to form a toner image on an image transfer belt;

a second image forming unit configured to form a toner image on the image transfer belt downstream of the first image forming unit;

a third image forming unit configured to form a toner image on the image transfer belt downstream of the second image forming unit;

a fourth image forming unit configured to form a toner image on the image transfer belt downstream of the third image forming unit;

a chassis configured to support a first exposure unit for exposing the first image forming unit, a second exposure unit for exposing the second image forming unit, a third exposure unit for exposing the third image forming unit, and a fourth exposure unit for exposing the fourth image forming unit, and the chassis comprising a first fitting portion, and a second fitting portion between the second exposure unit and the third exposure unit in a direction parallel to a conveyance direction; and a frame comprising a third fitting portion configured to fit with the first fitting portion, and a fourth fitting portion configured to fit with the second fitting portion, the frame configured to support the chassis whose relative position is positioned at the fourth fitting portion, the first image forming unit, the second image forming unit, the third image forming unit, the fourth image forming unit, and the image transfer belt, wherein one of the first fitting portion and the third fitting portion is an elongated hole having a long axis in a direction parallel to the conveyance direction, and the other of the first fitting portion and the third fitting portion is positioned within the elongated hole.

12. The image processing mechanism according to claim 11, wherein the chassis has the first fitting portion and the second fitting portion on a front side and a rear side.

13. The image processing mechanism according to claim 11, wherein the frame has the third fitting portion and the fourth fitting portion on a front side and a rear side.

14. The image processing mechanism according to claim 11, wherein the frame has the first fitting portions on left and right sides of the second fitting portion.

15. The image processing mechanism according to claim 14, wherein the first image forming unit comprises a fifth fitting portion, and the first exposure unit comprises a sixth fitting portion configured to fit with the fifth fitting portion.

16. The image processing mechanism according to claim 11, wherein the image transfer belt is positioned at an inclination angle whereby an upstream portion is higher than a downstream portion in the conveyance direction.

17. The image processing mechanism according to claim 11, further comprising a transfer belt cleaner.

18. The image processing mechanism according to claim 11, wherein the first image forming unit, the second image forming unit, the third image forming unit, and the fourth image forming unit independently comprises one of yellow toner, magenta toner, cyan toner, and black toner.

19. The image processing mechanism according to claim 11, wherein the first exposure unit, the second exposure unit, the third exposure unit, and the fourth exposure unit each comprise an LED array.

20. The image processing mechanism according to claim 11, wherein at least one of the first image forming unit, the second image forming unit, the third image forming unit, and the fourth image forming unit comprises a decolorable toner.

* * * * *